United States Patent [19]

Cain

[11] 4,396,045

[45] Aug. 2, 1983

[54] FEED CHUTE FOR PARTICULATE MATERIALS

[75] Inventor: Gilbert E. Cain, New Castle, Del.

[73] Assignee: Hercules Incorporated, Wilmington, Del.

[21] Appl. No.: 251,677

[22] Filed: Apr. 6, 1981

[51] Int. Cl.[3] ..... B65B 1/28

[52] U.S. Cl. ..... 141/286; 141/392; 55/360

[58] Field of Search ..... 141/7, 59, 285–310, 141/93, 98, 392, 325; 55/341 NT, 360, 361, 358, 373, 378

[56] References Cited

U.S. PATENT DOCUMENTS

| | | | |
|---|---|---|---|
| 2,838,076 | 1/1957 | Knight et al. | 141/1 |
| 3,766,712 | 10/1973 | Schaltenbrand | 55/360 |
| 3,904,070 | 9/1975 | Lisciani et al. | 220/88 R |
| 4,182,591 | 1/1980 | Stanelle | 141/93 |

FOREIGN PATENT DOCUMENTS

| | | | |
|---|---|---|---|
| 2736754 | 1/1979 | Fed. Rep. of Germany | 55/360 |
| 492560 | 3/1919 | France | 141/93 |
| 266115 | 2/1927 | United Kingdom | 141/93 |

*Primary Examiner*—Houston S. Bell, Jr.
*Attorney, Agent, or Firm*—John E. Crowe

[57] ABSTRACT

Apparatus to be used when pouring particulate matter into a container, for substantially eliminating the dust cloud and loss of material associated with particulate matter flow, by allowing for the escape of air while retaining the particulate material in a vessel and dissipating any buildup of electrostatic energy associated with the flow of particulate matter.

8 Claims, 3 Drawing Figures

FEED CHUTE FOR PARTICULATE MATERIALS

BACKGROUND OF THE INVENTION

1. Field of the Invention

This invention relates to apparatus to be used when pouring particulate materials into a container. This invention relates particularly to a feed chute for retaining substantially all of the particulate materials, including clouds of fine material, in the desired container while releasing entrapped air to the atmosphere. The invention also provides for dissipation of any electrostatic charges associated with the flow of the particulate matter stream.

2. Description of the Prior Art

A major problem in industry is eliminating dust when transferring particulate materials from one container to another in an operating area. If for example, particulate matter is being dumped from a bag into a hopper, normally a substantial amount of dust will blow back into the operating area. In the past, attempts have been made to reduce the amount of dust by the use of dust chutes or suction ventilation for dust removal to a conventional dust collector. For example, in current practice, forced air ventilation hoods are also used in areas where there is material transfer. Allowing clouds of dust to form and collect in an operating area creates a number of problems including loss of product, poor housekeeping conditions including slippery floors and possible employee exposure to toxic or flammable dust. The apparatus of this invention is designed to eliminate or greatly reduce the release of dust to an operating area during transfer of particulate matter. This invention will also minimize toxic or flammable dust conditions associated with the transfer of material in the operating area. Furthermore, the invention will reduce the cost of housekeeping. Finally a major advantage of the invention is the reduction of static electricity buildup caused by the material flowing into the desired vessel.

SUMMARY OF THE INVENTION

This invention includes apparatus for filling a container having an opening in the upper portion thereof for introducing particulate material into the container, the apparatus substantially reducing formation of a dust cloud and loss of particulate material when the particulate material is passed through the apparatus in filling of the container therewith, the apparatus comprising: (a) a cover for the opening in the upper portion of the container, the cover being a closure for the opening, the cover containing an aperture, and (b) a dust tube comprising a tubularly shaped cloth member having an upper open end and a lower open end, the upper open end being secured about the periphery of the aperture in the cover, said dust tube member depending into the container, the dust tube member tapering through at least a portion of its length toward the lower open end of the dust tube, the cloth member being permeable to the passage of air through the wall of cloth forming said member and being substantially impermeable to the passage of said particulate material.

DESCRIPTION OF THE PREFERRED EMBODIMENT

Figure 1:
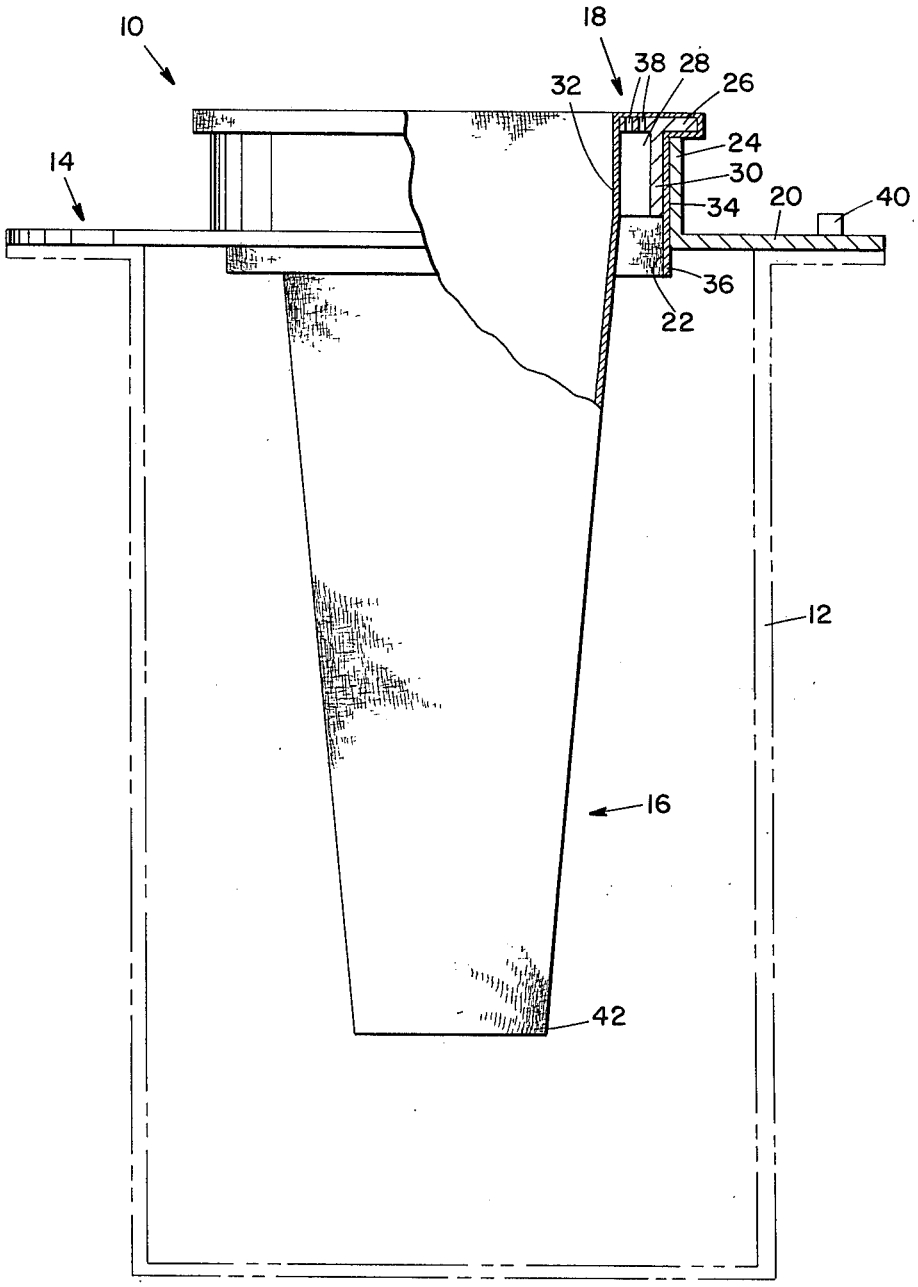
FIG. 1 is a side elevational view partly broken away and partly in section of the apparatus of the invention.
Figure 2:
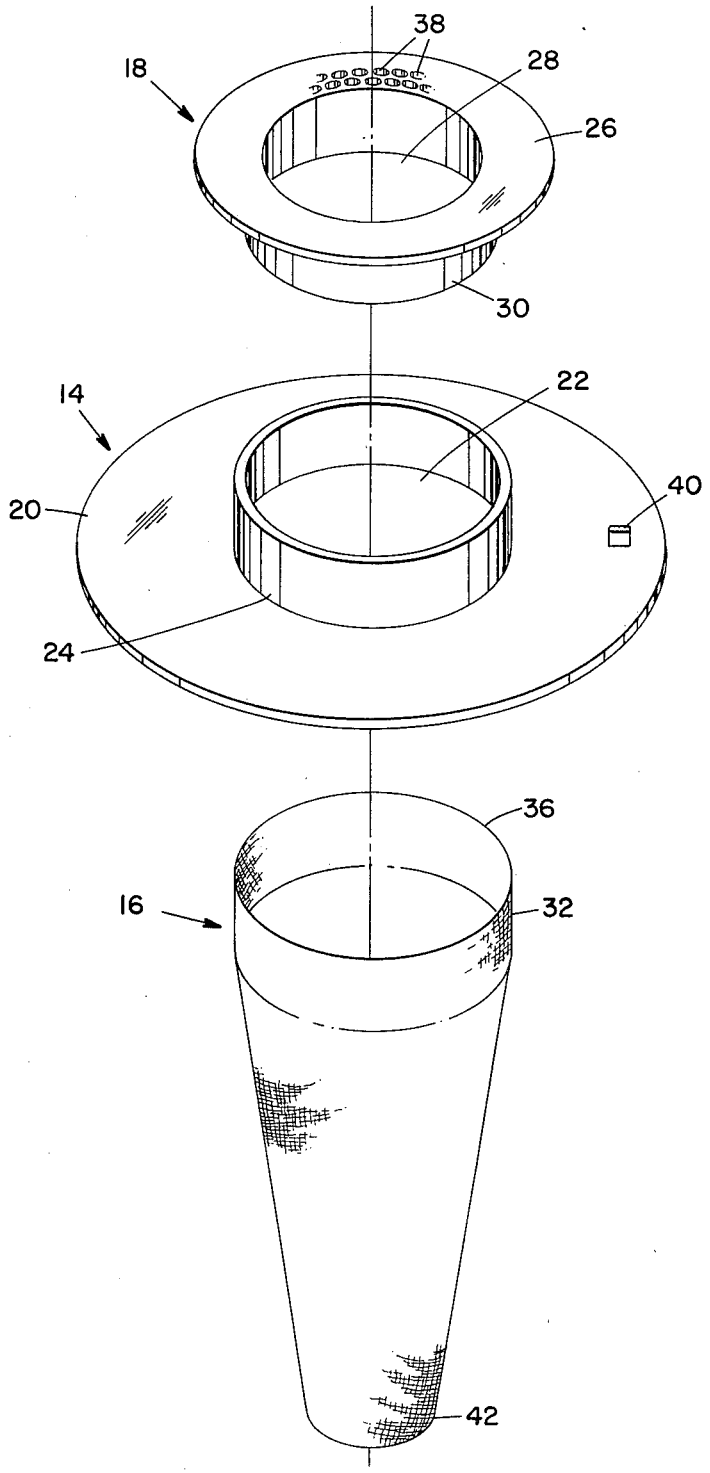
FIG. 2 is an exploded view, showing an embodiment of the invention.
Figure 3:
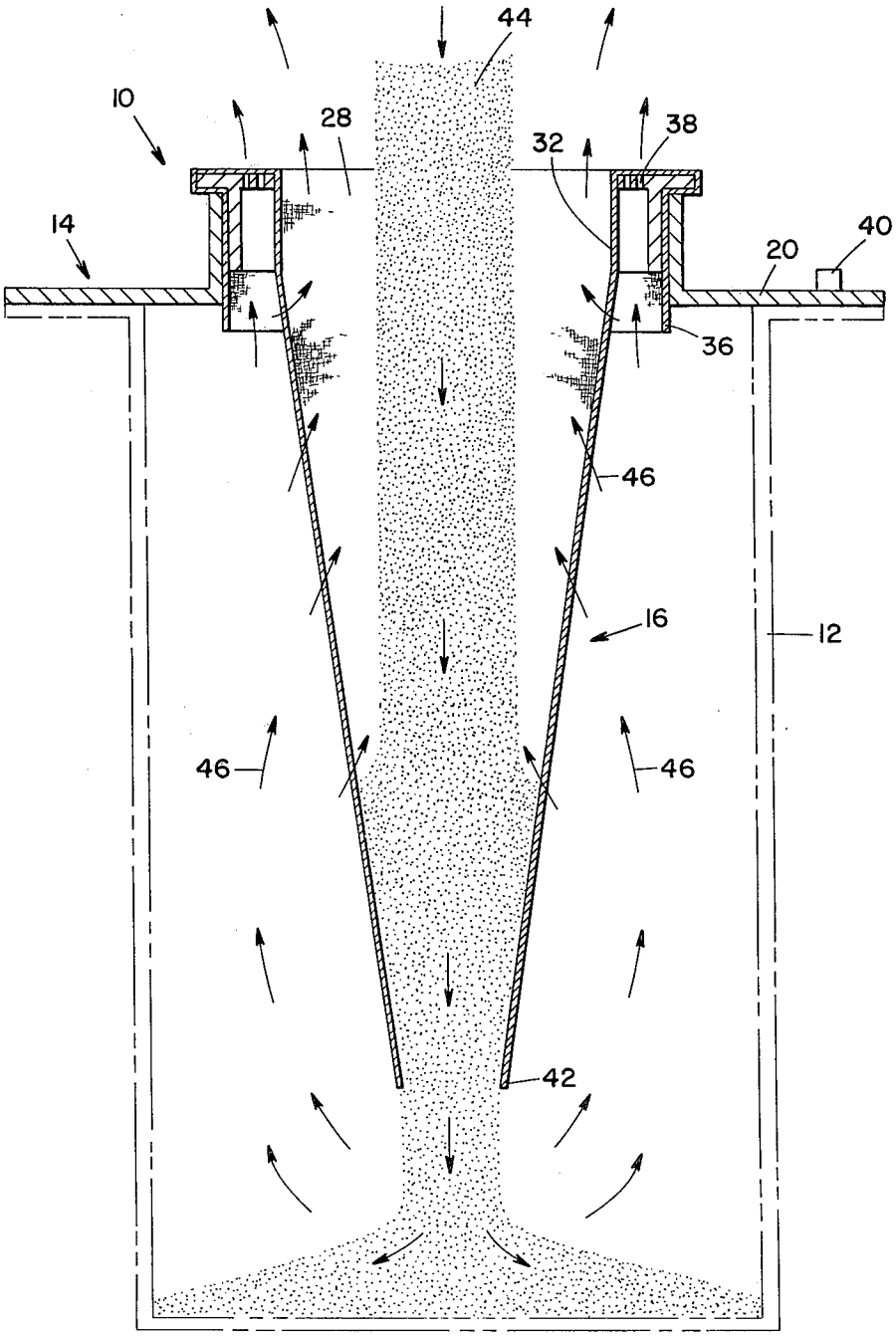
FIG. 3 is a side elevational view partly in section of an embodiment of the invention.

Referring now to the drawings in detail, there is illustrated in FIGS. 1–3 a preferred form of the apparatus of this invention which is designated in its entirety by the reference numeral 10. Feed chute 10 is placed on top of container 12 which represents the receiving vessel or receptacle for particulate matter. The invention includes first covering member 14, dust tube 16 and second covering member 18.

First covering member 14 in this embodiment comprises a flat circular ring 20 having a central aperture 22, and a sleeve 24. In this embodiment of the invention, sleeve 24 is attached to the circular ring 20 to provide a cylindrical opening through covering member 14. Sleeve 24 has a uniformly circular cross section and an inner diameter substantially equivalent to the diameter of central aperture 22 in circular ring 20. Second covering member 18 comprises a flat ring 26 having a central aperture 28 and a sleeve 30 having substantially the same inner diameter as aperture 28. Sleeve 30 is attached to ring 26 to form a cylindrical passageway through second covering member 18.

Dust tube 16 is a tubularly shaped cloth member adapted to be secured by first covering member 14 and second covering member 18 as shown in FIG. 1. A section of the upper portion 32 of dust tube 16, in operation of the invention is affixed to and supported by first covering member 14 and second covering member 18. Sleeve 30 has an outer diameter less than the inner diameter of sleeve 24 such that an annular region 34 is defined therebetween when second covering member 18 is placed atop first covering member 14. Annular region 34 is adapted to retain upper portion 32 of dust tube 16 in a friction fit between the exterior of sleeve 30 and the interior of sleeve 24. As shown in FIG. 1, upper portion 32 of dust tube 16 is fitted through apertures 22 and 28 over the top of second covering member 18 around its outer edge and down through annular region 34 between sleeves 24 and 30. Alternatively, end portion 36 of dust tube 16 may be adapted to extend down into the interior of vessel 12 to make contact with the particulate matter in the vessel. Dust tube 16 can be easily removed for cleaning or replacement by first removing second covering member 18.

Optionally, second covering member 18 may contain holes through flat ring 26 at locations inside the position of sleeve 30. Preferably an upper portion 32 of tube 16 covers holes 38.

In operation of the apparatus of this invention, the feed chute is placed atop the vessel to be filled. Ideally, the only opening from the interior of the vessel to the external atmosphere is through apertures 22 and 28. Variable closure means 42 located at the lower end of dust tube 16 is adapted to have the cross-sectional opening approximate the cross-sectional diameter of the particulate matter flow stream. Preferably the opening is adjusted to moderately impede the flow of material through variable closure means 42 located at the lower opening of dust tube 16 to force more of the particulate matter to contact the sides of dust tube 16. As shown in FIG. 3, during operation, particulate matter 44 is poured through apertures 22 and 28 down through dust tube 16 and into the interior of vessel 12. Air or other gaseous fluids 46, such as solvent vapors associated with the particulate matter flow stream, may exit the vessel up through dust tube 16 to the atmosphere. In addition, air may also exit through holes 38 located in the upper ring of covering number 18.

Holes 38 are preferably used to accelerate the removal of displaced air or vapors. Grounding post 40 located atop ring 20 provides the electrical connection between the apparatus of this invention and a suitable electrical ground (not shown). Preferably, holes 38 are covered with a portion of dust tube 16. If the flow of material through dust tube 16 has high enough velocity, escaping air may be somewhat restricted in flowing through the walls of dust tube 16 past the particulate matter flow stream and out of the feed chute. Holes 38 provide an accessible passageway for rapid escape of air in this case.

Dust tube 16 is conductive in accordance with the invention and in conductive contact with covering member 14. By appropriate connection (not shown), covering member 14 is connected to earth ground to dissipate any static electricity associated with the particulate matter flow stream down and any breakup of particles as the particulate matter flows down into vessel 12.

Dust tube 16 is preferably prepared from a conductive fabric. A preferred conductive fabric is prepared from Dacron$^R$ and steel threads. Other materials such as woven stainless steel fabric netting having conductive characteristics can be used. The variable opening at the lower end of dust tube 16 can be sized by variable closure means 42 for easy passage of particles therethrough. Sizing of the lower end of dust tube 16 depends on the flow characteristics and flow volume of the particulate matter involved. The weave of the fabric and the openings thereby created are chosen to insure impermeability to particulate matter flow, i.e., the fabric should be permeable to air and other gaseous fluids, but substantially impermeable to fine particles. Where the buildup of static electricity does not present a problem, alternatively, a non-conductive material can be used for dust tube 16. Dust tube 16, is a hollow member generally tubular through a substantial part of its length but, preferably tapering through a portion of its length toward its lower end. It is within the skill of the art to determine the exact dimensions for the dust tube for a specific application.

Preferably, covering members 14 and 18 are made from any conductive metal to provide good electrical conductivity between the dust tube and the ground connection. Lighter weight materials will allow easier movement of the feed chute from one vessel to another.

This invention is particularly useful with very fine particulate matter such as titanium dioxide pigment materials.

Additional benefits associated with the feed chute include a removable dust tube which can be easily cleaned for reuse with the same or different materials. Through use of this invention, if there were a flash fire in a vessel to which material was being transferred, the dust tube portion of the feed chute would blow backwards out of the vessel and act as a chimney or shield for the operator. In effect, flames and dust would be directed straight up into the air. An economic advantage of this invention is that it eliminates the need for an expensive dust removal system, thereby saving capital investment and the energy required to operate blowers and dust collectors.

It is to be understood that the above description and drawings are illustrative of this invention and not in limitation thereof. As will be evident to those skilled in the art, various modifications can be made in light of the foregoing disclosure and discussion without departure from the spirit or scope of the disclosure or from the scope of the claims.

What I claim and desire to protect by Letters Patent is:

1. Apparatus for filling an open container with particulate material while reducing formation and release of dust, said apparatus comprising a cover for closure of said open container;

an aperture in said cover to receive an incoming downstream flow of solid particulate material and partially vent gas displaced upstream by said incoming flow;

a plurality of openings in said cover arranged peripherally with respect to said aperture to accelerate venting of gas displaced upstream from the container by said incoming flow of solid particulate material;

a hollow dust tube comprising gas permeable filter material having upper and lower open ends, the upper open end being feedably arranged downstream from said aperture, fitted through said aperture and secured in filter tight relationship with respect to the plurality of openings in said cover, the lower open end being tapered through at least a portion of its length to substantially conform to the approximate cross-sectional diameter of the downstream-directed particulate flow stream, to moderately impede the flow of particulate material through said lower open end and block the free upstream passage of displaced gas and dust through said lower open end, whereby substantially all upstream displaced gas from the container passes through dust filter material.

2. The apparatus of claim 1 wherein said dust tube includes means for dissipating static electricity associated with said particulate matter flow.

3. The apparatus of claims 1 or 2 including means for demountably securing said dust tube to said cover.

4. The apparatus of claims 1 or 2 wherein said cover comprises a first covering member and a second covering member, said first covering member being a flat sheet, having attached thereto a cylindrical first sleeve having an internal diameter at least as large as the diameter of said aperture, wherein one of the open ends of said first sleeve is adjacent to and in registration with said aperture, and the other group end of said first sleeve is in communication with and provides support for said dust tube in the area of contact between said dust tube and said first covering member.

5. The apparatus of claim 4 wherein said dust tube has an adjustable opening at said lower open end to substantially conform to the approximate cross-sectional area of the particulate matter stream flowing through said lower open end.

6. The apparatus of claim 4 wherein said first sleeve is attached to said first member on its surface toward the exterior of the container to be filled, said dust tube is secured about the periphery of the aperture in said cover by said first sleeve of said first covering member and by said second covering member which includes a flat ring having a second central circular aperture, and a second sleeve, said second sleeve having a cross-sectional area slightly larger than the cross-sectional area of said second aperture said second sleeve being attached to said second covering member such that said second sleeve is in registration with said second aperture, the external diameter of said second sleeve being less than the internal diameter of said first sleeve such that a portion near the first open end of said dust tube can be demountably engaged in the annular region between the interior of said first sleeve and the exterior of said second sleeve.

7. The apparatus of claim 6 wherein said second covering member has a plurality of openings therethrough, said openings located between the periphery of said second aperture and the outer edge of said flat ring, said openings in communication with the interior of said container to be filled through the annular region between the interior of said second sleeve and the external surface of said dust tube to accelerate escape of displaced air or vapors.

8. The apparatus of claim 2 wherein said dust tube is a conductive woven fabric in conductive contact with said first covering member which is in conductive contact with earth ground to dissipate static electricity associated with said particulate matter flow.

* * * * *